US012268925B2

(12) United States Patent
Vasquez

(10) Patent No.: US 12,268,925 B2
(45) Date of Patent: Apr. 8, 2025

(54) EXERCISE MAT ASSEMBLY AND METHOD OF USE

(71) Applicant: Tegan Vasquez, Renton, WA (US)

(72) Inventor: Tegan Vasquez, Renton, WA (US)

( * ) Notice: Subject to any disclaimer, the term of this patent is extended or adjusted under 35 U.S.C. 154(b) by 134 days.

(21) Appl. No.: 18/131,651

(22) Filed: Apr. 6, 2023

(65) Prior Publication Data

US 2024/0335696 A1 Oct. 10, 2024

(51) Int. Cl.
*A63B 21/00* (2006.01)

(52) U.S. Cl.
CPC ..... *A63B 21/4037* (2015.10); *A63B 21/4039* (2015.10)

(58) Field of Classification Search
CPC ..... A63B 21/4037; A63B 21/4039
See application file for complete search history.

(56) References Cited

U.S. PATENT DOCUMENTS 4,621,809 A * 11/1986 Pearl ..... A63B 21/4029 482/104
4,911,347 A * 3/1990 Wilhite ..... A45F 3/14 224/264
D430,627 S 9/2000 Bergman
6,751,816 B1 * 6/2004 Wechsler ..... A47G 9/062 383/4
7,621,005 B1 * 11/2009 Harvey ..... A45C 11/20 5/503.1
7,657,952 B2 * 2/2010 Hutchison ..... A47G 9/062 482/142
7,665,165 B2 2/2010 Maganov
D626,773 S 11/2010 Oster
7,971,763 B2 * 7/2011 Chace ..... A45F 5/14 224/259
8,075,464 B2 12/2011 Hayes
9,220,359 B2 12/2015 Long
9,610,472 B2 4/2017 Willis
9,756,921 B2 * 9/2017 Bergman ..... A45C 9/00
10,039,368 B2 * 8/2018 Christman ..... A45F 3/14
10,953,271 B2 * 3/2021 Marchetti ..... A63B 21/4037
2005/0159279 A1 * 7/2005 Stangler ..... A63B 21/00047 482/148
2006/0040811 A1 * 2/2006 Foster ..... A63B 21/4039 482/148
2006/0043135 A1 * 3/2006 Lindsey ..... A45C 3/001 224/576
2008/0229501 A1 * 9/2008 Hutchison ..... A63B 21/4037 5/420
2009/0177121 A1 * 7/2009 Brandon ..... A63B 23/0244 128/845

(Continued)

FOREIGN PATENT DOCUMENTS

AU 2022100193 A4 * 2/2023
WO WO2008106688 9/2008

*Primary Examiner* — Nyca T Nguyen

(57) ABSTRACT

An exercise mat assembly for improving neck alignment includes a mat, which has a lower face that is positionable upon a substantially horizontal surface. The mat cushions a body of a user who is performing an exercise upon the mat. A pad is attached to an upper face of the mat proximate to a top end of the mat. The pad is formed so as to engage an upper portion and opposite sides of a neck of the user when the user is lying supine upon the mat. The pad thus cushions, supports, and aligns the neck of the user during performance of the exercise.

15 Claims, 6 Drawing Sheets

(56) References Cited

U.S. PATENT DOCUMENTS

| | | | | |
|---|---|---|---|---|
| 2009/0229048 | A1* | 9/2009 | Maganov | A63B 21/4037 482/148 |
| 2010/0032537 | A1* | 2/2010 | Andrews | A63B 21/4037 24/442 |
| 2010/0197471 | A1* | 8/2010 | Hayes | A63B 23/0211 482/142 |
| 2012/0124739 | A1* | 5/2012 | Crowne | A63B 21/4037 5/417 |
| 2012/0227181 | A1* | 9/2012 | Cintas | A47G 27/0237 112/475.08 |
| 2013/0211306 | A1* | 8/2013 | Murer | A61F 5/012 602/36 |
| 2013/0324382 | A1 | 12/2013 | Wilson | |
| 2019/0038953 | A1* | 2/2019 | Bell | H05B 47/16 |
| 2019/0351282 | A1* | 11/2019 | Rice | A63B 21/4037 |
| 2020/0121980 | A1* | 4/2020 | Griggs | A63B 21/4037 |
| 2020/0353307 | A1* | 11/2020 | Zanyk | A63B 21/4037 |
| 2021/0331029 | A1* | 10/2021 | Clarke | A63B 21/4037 |
| 2023/0285798 | A1* | 9/2023 | Zanyk | A63B 21/00047 |

* cited by examiner

EXERCISE MAT ASSEMBLY AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to exercise mats and more particularly pertains to a new exercise mat for improving neck alignment. The present invention discloses a mat with an integral pad that is configured to provide support to and alignment of a neck of a user.

(2) Description of Related Art Including Information Disclosed Under 37 CFR 1.97 and 1.98

The prior art relates to exercise mats, which may comprise cushions that are positionable upon surfaces to provide neck support and mats to which one or more cushions are selectively attachable. What is lacking in the prior art is an exercise mat comprising a mat with an integral pad that is configured to provide support to and alignment of a neck of a user.

(h) BRIEF SUMMARY OF THE INVENTION

An embodiment of the disclosure meets the needs presented above by generally comprising a mat, which has a lower face that is configured to be positioned upon a substantially horizontal surface. The mat is configured to cushion a body of a user who is performing an exercise upon the mat. A pad is attached to an upper face of the mat proximate to a top end of the mat. The pad is formed so as to engage an upper portion and opposite sides of a neck of the user when the user is lying supine upon the mat. The pad thus is configured to cushion, support, and align the neck of the user during performance of the exercise.

Another embodiment of the disclosure includes a method of cushioning, supporting, and aligning a neck of the user during performance of an exercise. Steps of the method include positioning a mat upon a substantially horizontal surface, assuming a supine position upon the mat, positioning oneself so that a pad attached to the mat so that it engages an upper portion and opposite sides of one's neck, and performing an exercise.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(J) DETAILED DESCRIPTION OF THE INVENTION

Figure 1:
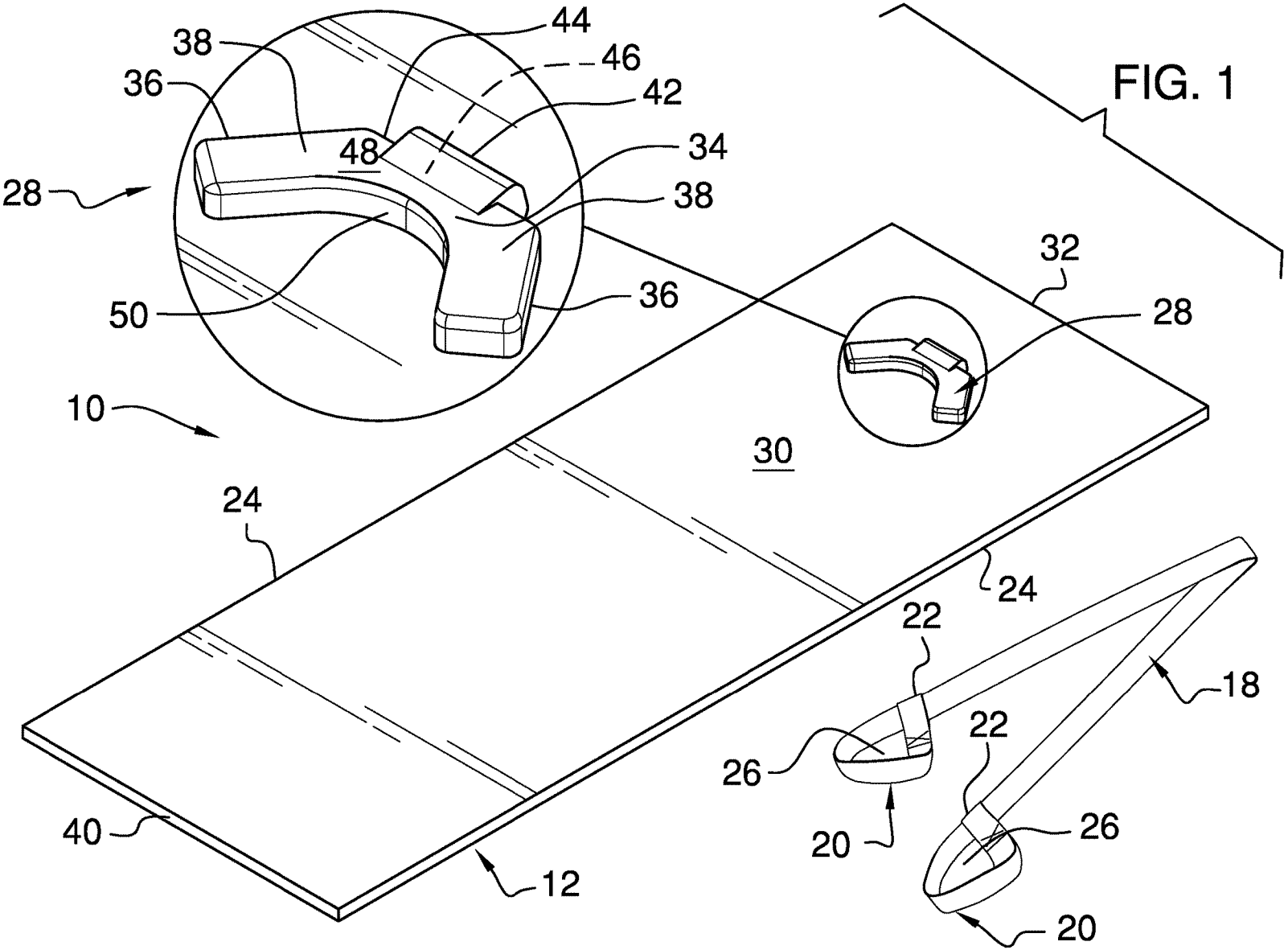
FIG. 1 is an isometric perspective view of an exercise mat assembly according to an embodiment of the disclosure.

With reference now to the drawings, and in particular to FIGS. 1 through 6 thereof, a new exercise mat embodying the principles and concepts of an embodiment of the disclosure and generally designated by the reference numeral 10 will be described.

Figure 2:
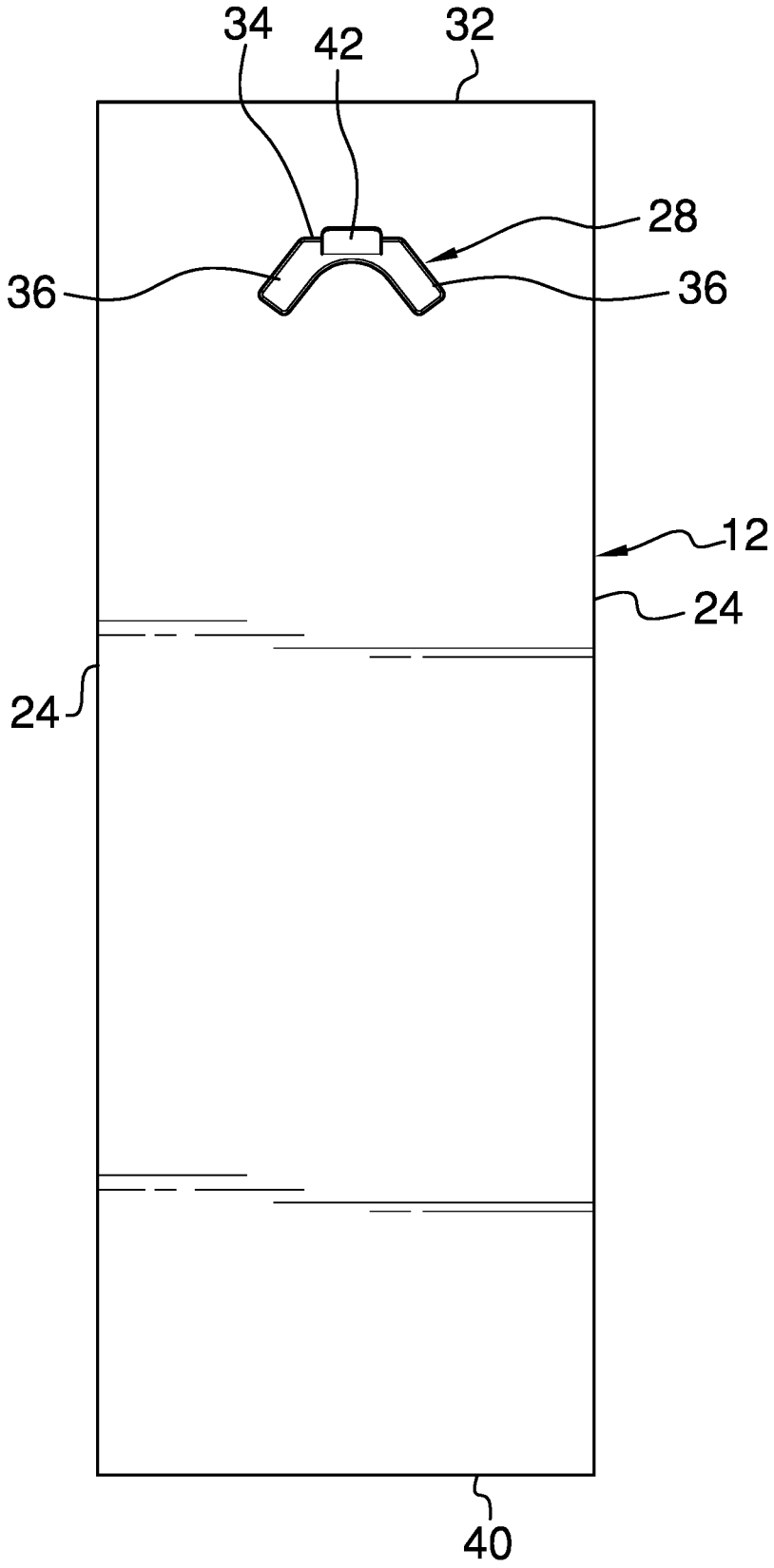
FIG. 2 is a top view of an embodiment of the disclosure.
Figure 3:
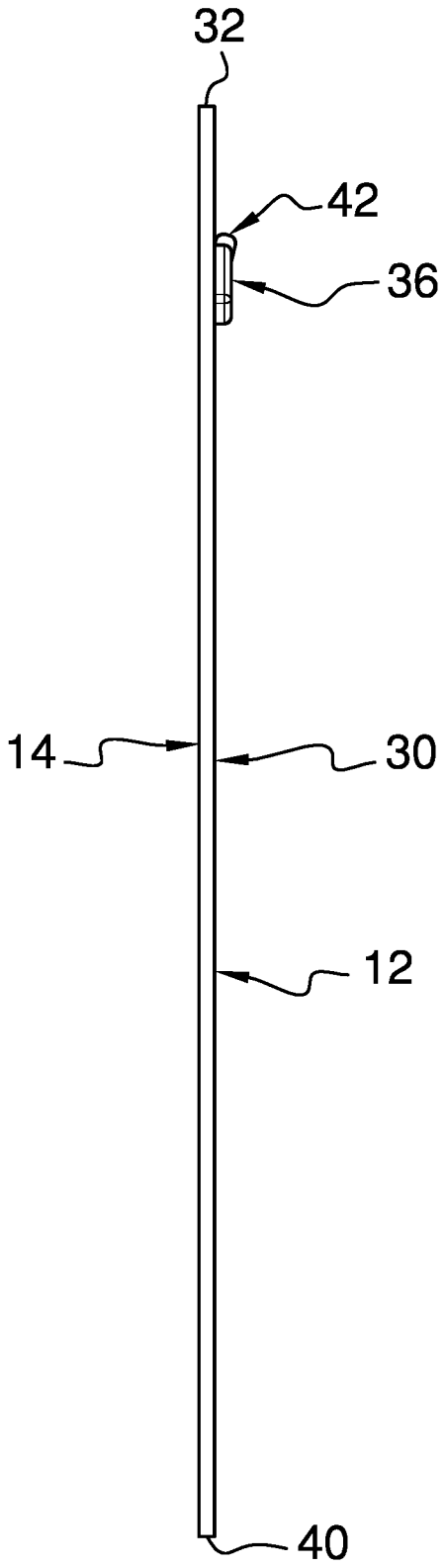
FIG. 3 is a side view of an embodiment of the disclosure.
Figure 4:
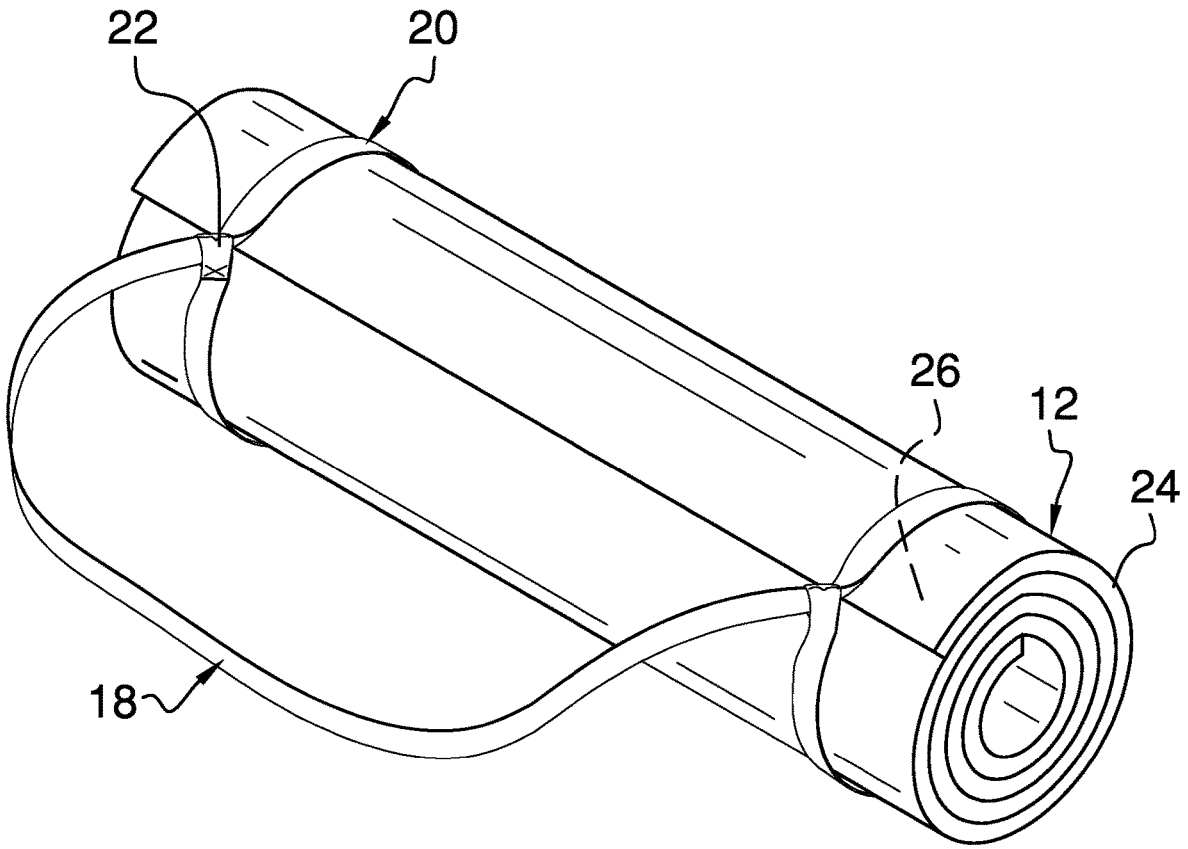
FIG. 4 is an isometric perspective view of an embodiment of the disclosure.

As best illustrated in FIGS. 1 through 6, the exercise mat assembly 10 generally comprises a mat 12, which has a lower face 14 that is configured to be positioned upon a substantially horizontal surface 16. The mat 12 is configured to cushion a body of a user who is performing an exercise upon the mat 12. The mat 12 is flexible so that the mat 12 is reversibly positionable in a substantially planar configuration and a rolled configuration, as shown in FIGS. 3 and 4, respectively.

The exercise mat assembly 10 also may comprise a strap 18 and a pair of fasteners 20. The fasteners 20 are attached singly to opposed ends 22 of the strap 18 and are configured to selectively attach to the mat 12, with the mat 12 in the rolled configuration, proximate to a respective opposed side 24 of the mat 12. The strap 18 is configured to be positioned over a shoulder of the user to facilitate carrying of the mat 12. The fastener 20 may comprise a loop 26 that is formed by attachment of a respective opposed end 22 of the strap 18 to the strap 18. The mat 12 in the rolled configuration thus is insertable into the loop 26, as shown in FIG. 4. The present invention also anticipates the fastener 20 comprises other fastening means, such as, but not limited to, hook and loops connectors, buckles, or the like.

The mat 12 may be substantially rectangular, as shown in FIG. 2. As shaping of the mat 12, within reasonable limits, is not critical to functioning of the exercise mat assembly 10, the present invention also anticipates the mat 12 being alternatively shaped, such as, but not limited to, having rounded corners, being elongated ovally shaped, or the like. Additionally, the mat 12 is anticipated to be available in a variety of dimensions for users of a variety of sizes, such as children, teenagers, average sized adults, and large sized adults.

Figure 5:
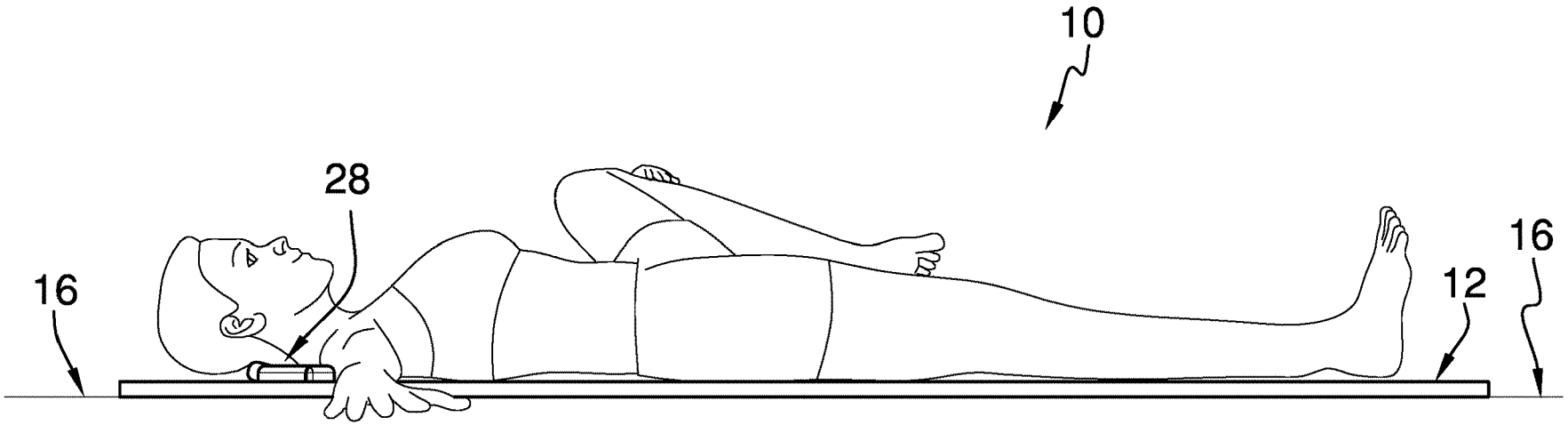
FIG. 5 is an in-use view of an embodiment of the disclosure.
Figure 6:
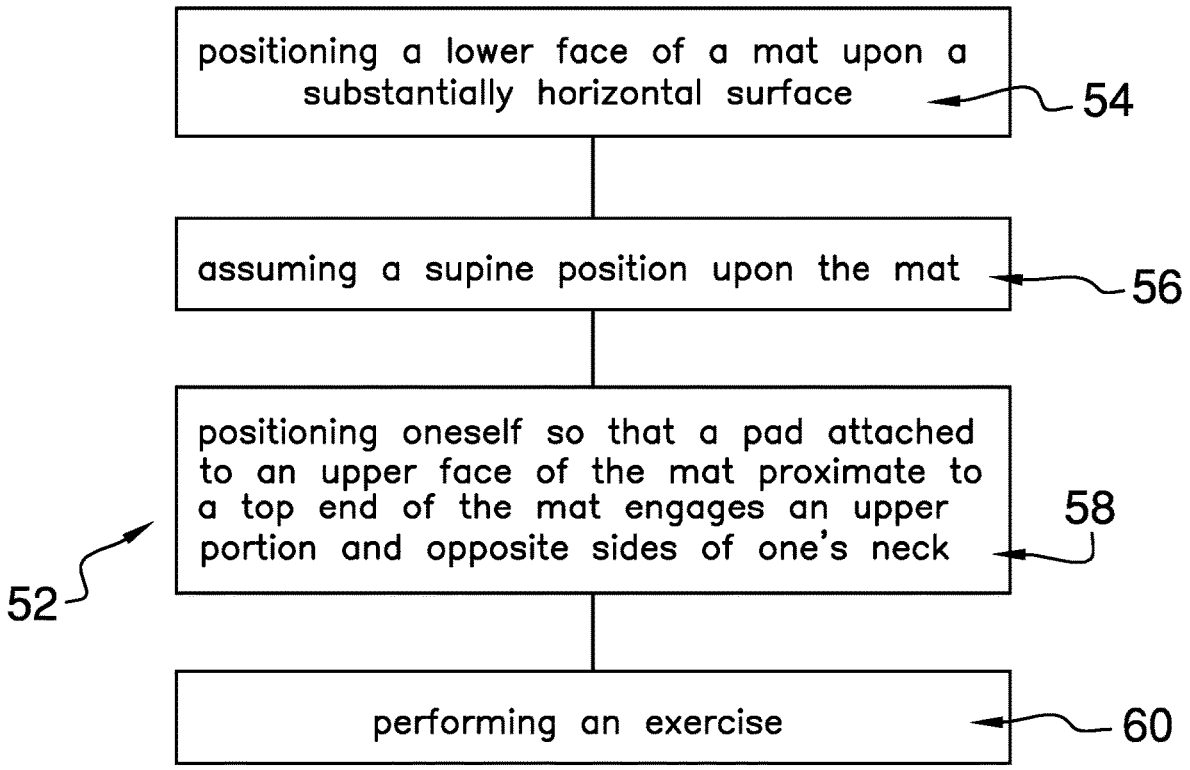
FIG. 6 is a flow diagram for a method utilizing an embodiment of the disclosure.

As shown in FIG. 2, a pad 28 is attached to an upper face 30 of the mat 12 proximate to a top end 32 of the mat 12. The pad 28 and the mat 12 comprise one or more of foamed elastomer, rubber, or polychloroprene. The pad 28 and the mat 12 may comprise viscoelastic polyurethane foam. The pad 28 is formed so as to engage an upper portion and opposite sides of a neck of the user when the user is lying supine upon the mat 12, as shown in FIG. 5. The pad 28 thus is configured to cushion, support, and align the neck of the user during performance of the exercise.

As shown in FIG. 1, the pad 28 comprises a first section 34 and a pair of second sections 36. The first section 34, which is substantially linear and parallel to the top end 32 of the mat 12, is configured to engage the upper portion of the neck of the user. Each second section 36 is attached to and extends from a respective opposite end 38 of the first section 34 toward a bottom end 40 of the mat 12. The second section 36 is configured to engage a respective opposite side of the neck of the user. As shown in FIG. 1, the second section 36 extends arcuately from the first section 34 so that the pad 28 is C-shaped. The present invention also anticipates the second sections 36 extending substantially perpendicularly to the first section 34.

The pad 28 also may comprise a third section 42, which is attached to and which extends from the first section 34 equally distant from its opposite ends 38. The third section 42 is configured to tilt a head of the user upwardly relative to the mat 12. As shown in FIG. 1, the third section 42 is attached to a first side 44 and a portion 46 of a top face 48 of the first section 34. The third section 42 is dimensionally thicker proximate to the first side 44 so that the third section 42 tapers toward a second side 50 of the first section 34.

In use, the exercise mat assembly 10 enables a method of cushioning, supporting, and aligning a neck of the user during performance of an exercise 52. A first step 54 of the method 52 is positioning a lower face 14 of a mat 12 upon a substantially horizontal surface 16. A second step 56 of the method 52 is assuming a supine position upon the mat 12. The mat 12 is configured for cushioning a body of the user. A third step 58 of the method 52 is positioning oneself so that a pad 28 attached to an upper face 30 of the mat 12 proximate to a top end 32 of the mat 12 engages an upper portion and opposite sides of one's neck. The pad 28 is configured to cushion, support, and align the neck of the user. A fourth step 60 of the method 52 is performing an exercise, an example of which is depicted in FIG. 5.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise mat assembly comprising:

a mat having a lower face configured for positioning upon a substantially horizontal surface, wherein the mat is configured for cushioning a body of a user performing an exercise upon the mat;

a pad attached to an upper face of the mat proximate to a top end of the mat, the pad being formed so as to engage an upper portion and opposite sides of a neck of the user when the user is lying supine upon the mat, wherein the pad is configured for cushioning, supporting, and aligning the neck of the user during performance of the exercise upon the mat; and wherein the pad comprises a first section, the first section being substantially linear and parallel to the top end of the mat, wherein the first section is configured for engaging the upper portion of the neck of the user, a pair of second sections, each second section of the pair of second sections being attached to and extending from a respective opposite end of the first section toward a bottom end of the mat, wherein the second section is configured for engaging a respective opposite side of the neck of the user, and a third section attached to and extending from the first section equally distant from the opposite ends, wherein the third section is configured for tilting a head of the user upwardly relative to the mat.

2. The exercise mat assembly of claim 1, wherein the mat is flexible, such that the mat is reversibly positionable in a substantially planar configuration and a rolled configuration.

3. The exercise mat assembly of claim 2, wherein the mat comprises one or more of foamed elastomer, rubber, or polychloroprene.

4. The exercise mat assembly of claim 3, wherein the mat comprises viscoelastic polyurethane foam.

5. The exercise mat assembly of claim 2, furthering including:

a strap; and a pair of fasteners attached singly to opposed ends of the strap, each fastener of the pair of fasteners being configured for selectively attaching to the mat, with the mat in the rolled configuration, proximate to a respective opposed side of the mat, wherein the strap is configured for positioning over a shoulder of the user for carrying the mat.

6. The exercise mat assembly of claim 5, wherein the fastener comprises a loop formed by attachment of a respective opposed end of the strap to the strap, such that the mat in the rolled configuration is insertable into the loop.

7. The exercise mat assembly of claim 1, wherein the pad comprises one or more of foamed elastomer, rubber, or polychloroprene.

8. The exercise mat assembly of claim 7, wherein the pad comprises viscoelastic polyurethane foam.

9. The exercise mat assembly of claim 1, wherein the mat is substantially rectangular.

10. The exercise mat assembly of claim 1, wherein the second section extends arcuately from the first section, such that the pad is C-shaped.

11. The exercise mat assembly of claim 1, wherein the third section is attached to a first side and a portion of a top face of the first section, the third section being dimensionally thicker proximate to the first side, such that the third section tapers toward a second side of the first section.

12. An exercise mat assembly comprising:

a mat having a lower face configured for positioning upon a substantially horizontal surface, wherein the mat is configured for cushioning a body of a user performing an exercise upon the mat, the mat being flexible, such that the mat is reversibly positionable in a substantially planar configuration and a rolled configuration, the mat comprising one or more of foamed elastomer, rubber, or polychloroprene, the mat comprising viscoelastic polyurethane foam, the mat being substantially rectangular;

a pad attached to an upper face of the mat proximate to a top end of the mat, the pad being formed so as to engage an upper portion and opposite sides of a neck of the user when the user is lying supine upon the mat, wherein the pad is configured for cushioning, supporting, and aligning the neck of the user during performance of the exercise upon the mat, the pad comprising:

a first section, the first section being substantially linear and parallel to the top end of the mat, wherein the first section is configured for engaging the upper portion of the neck of the user, a pair of second sections, each second section of the pair of second sections being attached to and extending from a respective opposite end of the first section toward a bottom end of the mat, wherein the second section is configured for engaging a respective opposite side of the neck of the user, the second section extending arcuately from the first section, such that the pad is C-shaped, and a third section attached to and extending from the first section equally distant from the opposite ends, wherein the third section is configured for tilting a head of the user upwardly relative to the mat, the third section being attached to a first side and a portion of a top face of the first section, the third section being dimensionally thicker proximate to the first side, such that the third section tapers toward a second side of the first section;

the pad comprising one or more of foamed elastomer, rubber, or polychloroprene, the pad comprising viscoelastic polyurethane foam;

a strap; and a pair of fasteners attached singly to opposed ends of the strap, each fastener of the pair of fasteners being configured for selectively attaching to the mat, with the mat in the rolled configuration, proximate to a respective opposed side of the mat, wherein the strap is configured for positioning over a shoulder of the user for carrying the mat, the fastener comprising a loop formed by attachment of a respective opposed end of the strap to the strap, such that the mat in the rolled configuration is insertable into the loop.

13. A method of cushioning, supporting, and aligning a neck of the user during performance of an exercise comprising the steps of:

positioning a lower face of a mat upon a substantially horizontal surface;

assuming a supine position upon the mat, wherein the mat is configured for cushioning a body of a user;

positioning the user so that a pad attached to an upper face of the mat proximate to a top end of the mat engages an upper portion and opposite sides of the neck of the user, wherein the pad is configured for cushioning, supporting, and aligning the neck of the user;

performing an exercise; and wherein the pad comprises a first section, the first section being substantially linear and parallel to the top end of the mat, wherein the first section is configured for engaging the upper portion of the neck of the user; and a pair of second sections, each second section of the pair of second sections being attached to and extending from a respective opposite end of the first section toward a bottom end of the mat, wherein the second section is configured for engaging a respective opposite side of the neck of the user, and a third section attached to and extending from the first section equally distant from the opposite ends, wherein the third section is configured for tilting a head of the user upwardly relative to the mat.

14. The method of claim 13, wherein the second section extends arcuately from the first section, such that the pad is C-shaped.

15. The method of claim 13, wherein the third section is attached to a first side and a portion of a top face of the first section, the third section being dimensionally thicker proximate to the first side, such that the third section tapers toward a second side of the first section.

* * * * *